US007950593B2

(12) United States Patent
Wang et al.

(10) Patent No.: US 7,950,593 B2
(45) Date of Patent: May 31, 2011

(54) Z ORIFICE FEATURE FOR MECHANICALLY ACTUATED FUEL INJECTOR

(75) Inventors: Lifeng Wang, Dunlap, IL (US); Koti R. Padarthy, Edwards, IL (US); Gengxun K. Gurley, Peoria, IL (US); Kyle E. Enzinger, Pontiac, IL (US)

(73) Assignee: Caterpillar Inc., Peoria, IL (US)

( * ) Notice: Subject to any disclaimer, the term of this patent is extended or adjusted under 35 U.S.C. 154(b) by 213 days.

(21) Appl. No.: 12/214,623

(22) Filed: Jun. 20, 2008

(65) Prior Publication Data

US 2009/0314860 A1 Dec. 24, 2009

(51) Int. Cl.
*F02D 1/06* (2006.01)

(52) U.S. Cl. ..... 239/5; 239/88; 239/96; 239/124; 239/533.3; 239/585.1; 123/446

(58) Field of Classification Search ..... 239/5, 88, 239/96, 124, 127, 533.3, 533.4, 585.1; 123/446, 123/467

See application file for complete search history.

(56) References Cited

U.S. PATENT DOCUMENTS 6,267,306 B1 * 7/2001 Phillips et al. ..... 239/585.1
6,279,843 B1 8/2001 Coldren et al.
6,595,189 B2 * 7/2003 Coldren et al. ..... 123/467
6,843,434 B2 * 1/2005 Lawrence et al. ..... 239/533.4
6,889,918 B2 5/2005 Harcombe
7,111,613 B1 * 9/2006 Barnes et al. ..... 123/467
7,331,329 B2 2/2008 Tian et al.
2005/0194462 A1 * 9/2005 Coldren et al. ..... 239/88

* cited by examiner

*Primary Examiner* — Steven J Ganey
(74) *Attorney, Agent, or Firm* — Liell & McNeil

(57) ABSTRACT

A mechanically actuated electronically controlled fuel injector (MEUI) includes a first electrical actuator that controls the position of a spill valve, and a second electrical actuator to control pressure on a closing hydraulic surface associated with a directly operated nozzle check valve. The fuel injector is actuated via rotation of a cam to move a plunger to displace fuel from a fuel pumping chamber either to a spill passage, or at high pressure out of a nozzle outlet of the fuel injector for an injection event. The minimum controllable fuel injection quantity, especially as it relates to small closely coupled post injections following a large main injection, is accomplished by the inclusion of a Z orifice passage that maintains a fluid connection between a needle control chamber and the nozzle supply passage. The inclusion of the Z orifice passage slows the rate at which pressure drops in the needle control chamber to commence an injection event, but also hastens the rate at which pressure builds in the needle control chamber to end an injection event. The result is a smaller post injection quantity and, if desired, a longer, shorter or same dwell time between injection events.

16 Claims, 3 Drawing Sheets

Z ORIFICE FEATURE FOR MECHANICALLY ACTUATED FUEL INJECTOR

TECHNICAL FIELD

The present disclosure relates generally to mechanically actuated electronically controlled fuel injection systems, and more particularly to a Z orifice for a direct operated nozzle check valve, such as to achieve small close coupled post injections.

BACKGROUND

Mechanically actuated electronically controlled unit injectors (MEUI) have seen great success in compression ignition engines for many years. In recent years, MEUI injectors have acquired additional control capabilities via a first electrical actuator associated with a spill valve and a second electrical actuator associated with a direct operated nozzle check valve. MEUI fuel injectors are actuated via rotation of a cam, which is typically driven via appropriate gear linkage to an engine's crankshaft. Fuel pressure in the fuel injector will generally remain low between injection events. As the cam lobe begins to move a plunger, fuel is initially displaced at low pressure to a drain via the spill valve for recirculation. When it is desired to increase pressure in the fuel injector to injection pressure levels, the first electrical actuator is energized to close the spill valve. When this is done, pressure quickly begins to rise in the fuel injector because the fuel pressurization chamber becomes a closed volume when the spill valve closes. Fuel injection commences by energizing the second electrical actuator to relieve pressure on a closing hydraulic surface associated with the direct operated nozzle check valve. The closing hydraulic surface of the directly operated nozzle check valve is located in a needle control chamber which is alternately connected to the pumping chamber or a low pressure drain by moving a needle control valve with the second electrical actuator. Such a control valve structure is shown, for example, in U.S. Pat. No. 6,889,918. The nozzle check valve can be opened and closed any number of times to create an injection sequence consisting of a plurality of injection events by relieving and then re-applying pressure onto the closing hydraulic surface of the nozzle check valve. These multiple injection sequences have been developed as one strategy for burning the fuel in a manner that reduces the production of undesirable emissions, such as NOx, unburnt hydrocarbons and particulate matter, in order to avoid over reliance on an exhaust aftertreatment system.

One multiple injection sequence that has shown the ability to reduce undesirable emissions includes a relatively large main injection followed closely by a small post injection. Because the nozzle check valve must inherently be briefly closed between the main injection event and the post-injection event, pressure in the fuel injector may surge due to the continued downward motion of the plunger in response to continued cam rotation. In addition, past experience suggests that conditions within the fuel injector immediately after a main injection event are highly dynamic, unsettled and somewhat unstable, making it difficult to controllably produce a small post injection quantity. Thus, if the dwell between the main injection event and the post-injection event is too long, the increased pressure in the fuel injector will undermine the ability to produce small post injection quantities but the more stable environment renders the post injection more controllable. In other words, the longer the dwell, the larger the post injection pressure coupled with greater controllability. If the dwell is too short, the dynamic unsettled condition makes any small past injection quantity difficult to deliver with consistency. Thus, the inherent structure and functioning of MEUI injectors makes it difficult to control fuel pressure during an injection sequence because the fuel pressure is primarily dictated by plunger speed (engine speed) and the flow area of the nozzle outlets, if they are open, but the unstable time period immediately after main injection makes any post injection quantity more variable and less predictable. As expected, the pressure surging problem as well as the shrinking post injection timing window can become more pronounced at higher engine speeds and loads, which may be the operational state at which a closely coupled small post injection is most desirable. The inherent functional limitations of known MEUI systems may prevent small close coupled post injections both in desired quantity and timing relative to the end of the preceding main injection event in order to satisfy ever more stringent emissions regulations.

The present disclosure is directed to overcoming one or more of the problems set forth above.

SUMMARY

In one aspect, the fuel injector includes an injector body that defines a nozzle outlet. A cam actuated plunger is slidably positioned in the injector body and coupled to a tappet extending outside the injector body. A direct control nozzle check valve includes a closing hydraulic surface exposed to fluid pressure in a needle control chamber, and an opening hydraulic surface exposed to fluid pressure in a nozzle chamber. The plunger and the injector body define a pumping chamber fluidly connected to the nozzle chamber via a nozzle supply passage. The needle control chamber is always fluidly connected to the nozzle supply passage via a Z orifice passage. A needle control valve is positioned in the injector body, and movable between a first position at which the needle control chamber is fluidly connected to a low-pressure passage, and a second position at which the needle control chamber is fluidly connected to the nozzle supply passage.

In another aspect, a method of operating a fuel injector includes closing a spill valve while moving a plunger of the fuel injector in response to rotation of a cam. A fluid connection is maintained between a nozzle supply passage and a needle control chamber via a Z orifice passage. A nozzle check valve is opened by fluidly connecting the needle control chamber to a low-pressure passage via a pressure communication passage. The nozzle check valve is then closed.

DETAILED DESCRIPTION

Figure 1:
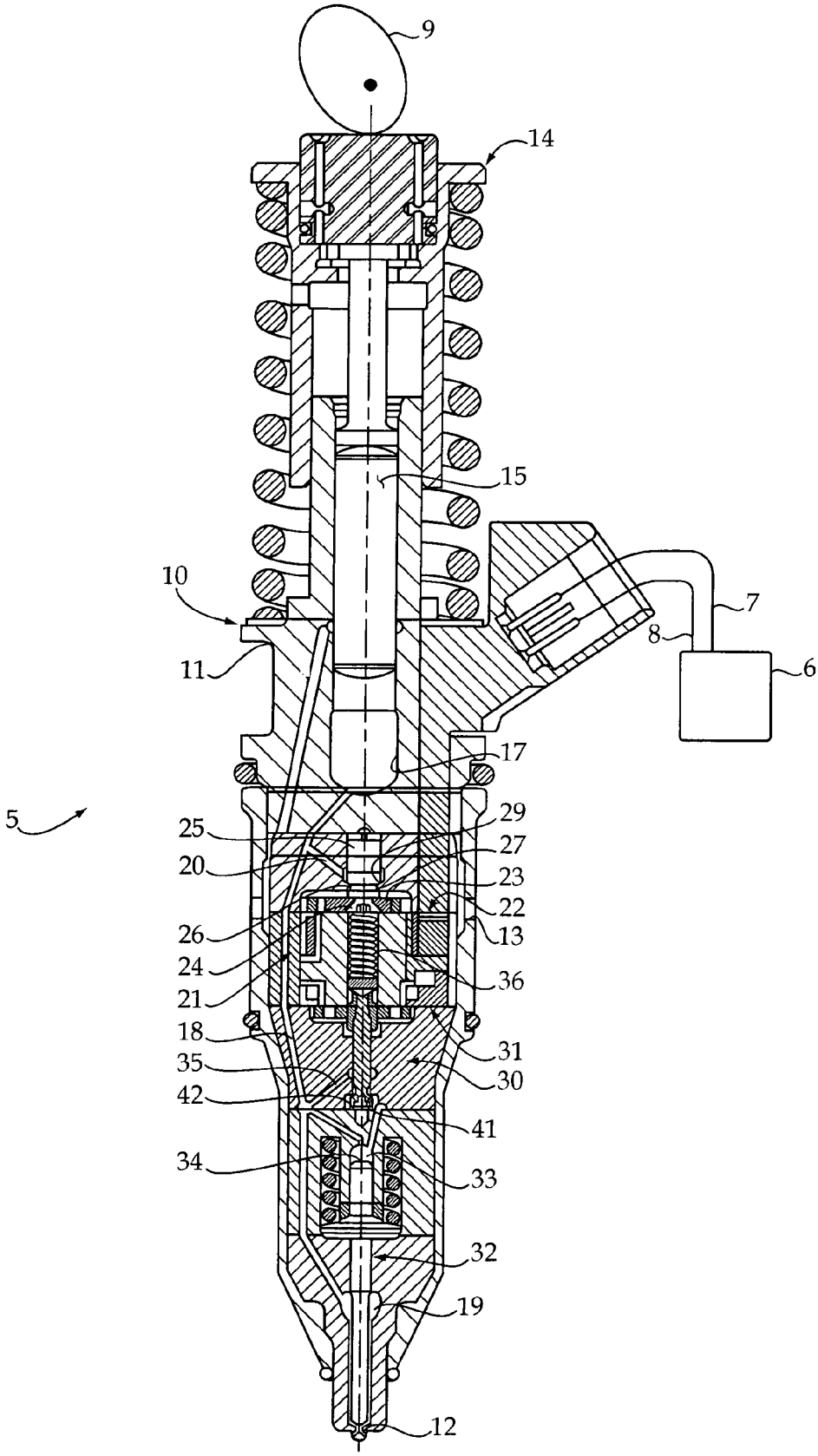
FIG. 1 is a side sectioned diagrammatic view of a fuel injector according to one aspect of the present disclosure.
Figure 2:
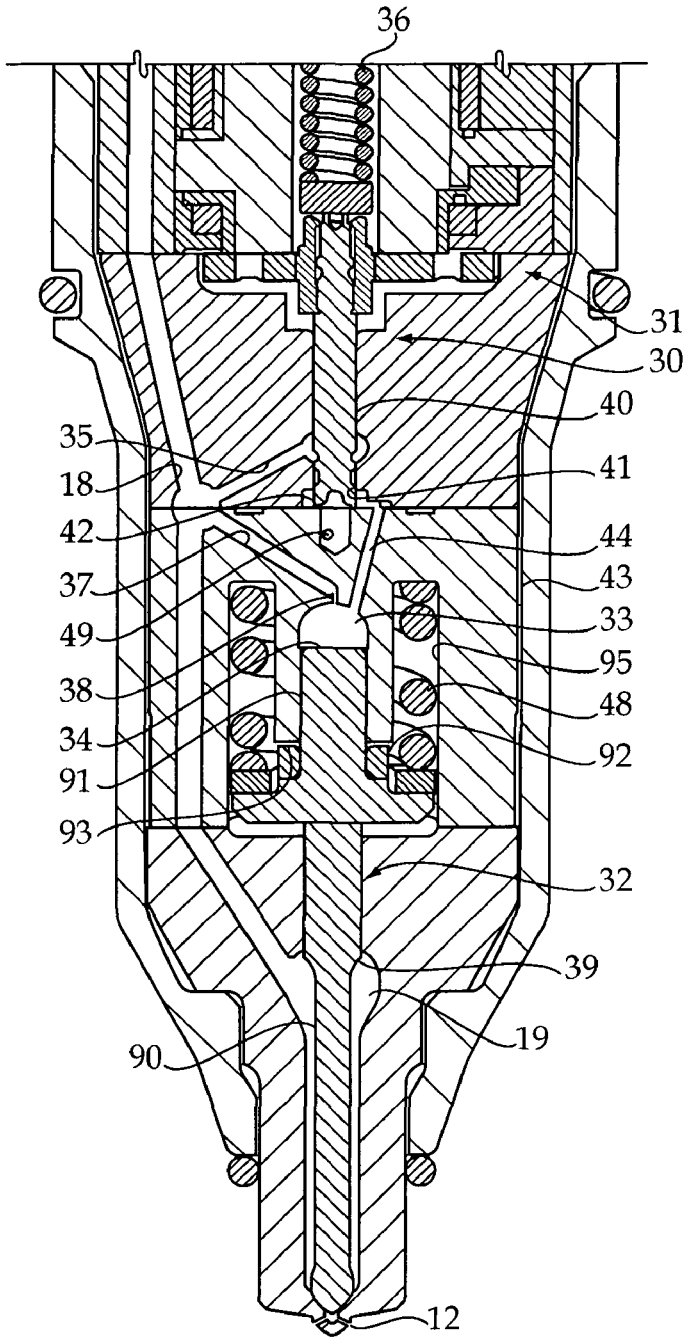
FIG. 2 is an enlarged side sectioned diagrammatic view of the nozzle control portion of the fuel injector shown in FIG. 1.

Referring to FIGS. 1 and 2, a fuel system 5 includes a mechanical electronic unit fuel injector 10 that is actuated via rotation of a cam 9 and controlled by an electronic controller 6. Fuel injector 10 includes a first electrical actuator 21 operably coupled to a spill valve 22, and a second electrical actuator 31 operably coupled to control pressure in a needle control chamber 33 via a needle control valve 30. The first and the second electrical actuators 21 and 31 are energized and de-energized via control signals communicated from electronic controller 6 via communication lines 7 and 8, which may be wireless. Fuel injector 10 includes an injector body 11 made up of a plurality of components that together define several fluid passageways and chambers. In particular, a pumping chamber 17 is defined by injector body 11 and a cam driven plunger 15. When plunger 15 is driven downward due to rotation of cam 9 acting on tappet 14, fuel is displaced into a spill passage 20, past spill valve 22, and out a drain passage (not shown) that is fluidly connected to fuel supply/return opening 13. As shown, tappet 14 extends outside of injector body 11. When first electrical actuator 21 is energized, a spill valve member 25 is moved with an armature 23 until a valve surface 26 comes in contact with an annular valve seat 29 to close spill passage 20. When this occurs, fuel pressure in pumping chamber 17 increases, as well as a fuel pressure in nozzle chamber 19 via the fluid connection provided by fuel passage 18. Spill valve member 25 is normally biased to a fully open position via a compression biasing spring 36. Biasing spring 36 also serves to bias the needle control valve 30 to a configuration that fluidly connects needle control chamber 33 to pressure connection passage 35, which is fluidly connected to fuel passage 18.

Pressure in needle control chamber 33 acts upon a closing hydraulic surface 34 associated with nozzle check valve 32. As long as pressure in needle control chamber 33 is high, nozzle check valve 32 will remain in, or move toward, a closed position blocking nozzle outlets 12. When second electrical actuator 31 is energized, needle control valve 30 moves to a position that blocks pressure connection passage 35, and instead fluidly connects needle control chamber 33 to low pressure fuel supply/return opening 13 via a low pressure passage 49 partially shown in FIG. 2. When pressure in needle control chamber 33 is low and pressure in nozzle chamber 19 is above a valve opening pressure (VOP) of the nozzle check valve 32, the nozzle check valve 32 will lift to an open position to allow fuel to spray through nozzle outlets 12 in a conventional manner. The value opening pressure corresponds to the pressure at which the lifting hydraulic force is greater than the spring 48 preload plus the decaying pressure force acting on the closing hydraulic surface 34.

The features associated with nozzle control are shown in greater detail in FIG. 2. In particular, needle control valve 30 includes a control valve member 40 that is normally biased downward into contact with a low-pressure flat seat 42 via the action of biasing spring 36. When in this position, needle control chamber 33 is fluidly connected to nozzle supply passage 18 via connection passage 35, and pressure communication passage 44. When second electrical actuator 31 is energized, control valve member 40 is lifted to open flat seat 42 and close conical high-pressure seat 41. When in this position, needle control chamber 33 is fluidly connected to low-pressure passage 49 via pressure communication passage 44. Regardless of the position of control valve member 40, needle control chamber 33 is always fluidly connected to nozzle supply passage 18 via an unobstructed Z orifice passage 37. Z orifice passage includes a flow restriction commonly referred to in the art as a Z orifice 38. The term "unobstructed" is intended to mean fluid passageways that are free of valves or other structures that could close the passage to either fluid flow or pressure communication. When electrical actuator 31 is de-energized and control valve member 40 is in its downward position to close flat low-pressure seat 42, needle control chamber 33 is fluidly connected to nozzle supply passage 18 both through Z orifice passage 37, and via connection passage 35 and pressure communication passage 44. As such, high pressure in nozzle supply passage 18 has two avenues with which to enter needle control chamber 33 and act upon closing hydraulic surface 34 to hold nozzle check valve 32 in a closed position, or move the same toward a closed position where a check lift spacer 92 may be out of contact with stop surface 93. Pressure in needle control chamber 33 drops when control valve member 40 is lifted to close conical high-pressure seat 41 and open the fluid connection to drain passage 49, because the flow area out of needle control chamber 33 toward low-pressure drain 49 via pressure communication passage 44 is larger than the flow area of the Z orifice 38. The various areas of closing hydraulic surface 34 and opening hydraulic surface 39 are sized such that nozzle check valve 32 will lift and move upward toward its open position with check lift spacer 92 in contact with stop surface 93 when pressure in nozzle chamber 19 is above a valve opening pressure associated with the pre-load on biasing spring 48, which normally biases nozzle check valve 32 downward towards a closed position. As shown, the needle control chamber 33, the Z orifice passage 37 and the needle biasing spring 48 may be disposed in a spring cage component 43 of injector body 11. Although nozzle check valve 32 may be of unitary construction, in the illustrated embodiment it includes a needle 90, a check lift spacer 92 and a piston 91. Together, piston 91 and spring cage component 43 define needle control chamber 33. Also, the needle biasing spring 48 is received in an annular cavity 95 defined by spring cage component 43. Nevertheless, numerous alternative structural details would fall within the intended scoped of the disclosure.

The structure is illustrated in FIGS. 1 and 2 differs from the predecessor injectors by the inclusion of the Z orifice passage 37. This feature has the function of allowing pressure to more quickly rise in needle control chamber 33 to facilitate an end of an injection event. In addition, this structure delays or slows the rate at which pressure drops in needle control chamber 33 relative to predecessor injectors due to the extra fluid connection provided by Z orifice passage 37. In addition, pressure in the needle control chamber 33 never drops to the low levels associated with the predecessor fuel injector because of the fluid connection maintained by the Z orifice passage 37. As a consequence, one could expect the nozzle check valve 32 to lift toward an open position slightly slower than predecessor injectors, but close quicker than the counterpart predecessor in the face of identical fuel pressures and control signals. In addition, because the needle control chamber 33 is maintained at a higher pressure level during an injection event, the operation of direct control nozzle check valve 32 is more controllable or responsive than in the counterpart predecessor fuel injector. It is this ability that allows for an improvement over the predecessor injectors by providing a mechanism by which the dwell between a main injection event and a closely coupled post-injection event can be slightly lengthened, shortened or maintained the same while at the same time decreasing the quantity of fuel injected in the post-injection. This combination of the dwell control and post injection quantity reduction has shown the ability to improve emissions over the predecessor fuel injectors that did not include the extra Z orifice passage 37. Thus, by the addition of a Z orifice passage 37 to a predecessor fuel injector, an improvement in emissions reductions can be achieved, especially at those operating conditions that call for injection sequences that include a closely coupled small post injection event.

INDUSTRIAL APPLICABILITY

The present disclosure finds potential application to any fuel system that utilizes mechanically actuated electronically controlled fuel injectors with at least one electrical actuator operably coupled to a spill valve and a nozzle check valve. Although both the spill valve and the nozzle check valve may be controlled with a single electrical actuator within the intended scope of the present disclosure, a typical fuel injector according to the present disclosure will include a first electrical actuator associated with the spill valve and a second electrical actuator associated with the nozzle check valve. Any electrical actuator may be compatible with the fuel injectors of the present disclosure, including solenoid actuators as illustrated, but also other electrical actuators including piezo actuators. The present disclosure finds particular suitability in compression ignition engines that benefit from an ability to produce injection sequences that include a relatively large main injection followed by a closely coupled small post-injection, especially at higher speeds and loads in order to reduce undesirable emissions at the time of combustion rather than relying upon after-treatment systems. The present disclosure also recognizes that every fuel injector exhibits a minimum controllable injection event duration, below which behavior of the injector becomes less predictable and more varied.

The minimum controllable injection event duration for a given fuel injector relates to that minimum quantity of fuel that can be repeatedly injected with the same control signal without substantial variance. This phenomenon recognizes that in order to perform an injection event, certain components must move from one position and then back to that original position with some predictable repeated behavior in order to produce a controllable event. When the durations get too small, pressure fluctuations are too large and components are less than settled, leading to exhibit erratic behavior due to bouncing before coming to a stop and other phenomena that give rise to nonlinear and erratic behavior for various short and small quantity injection events. The present disclosure is primarily associated with the minimal controllable injection event, especially when such an event occurs after a large main injection event. Thus, the present disclosure recognizes that simply decreasing the duration of the post-injection event may theoretically produce a smaller injection quantity, but the uncontrollable variations on that quantity become unacceptable, thus defeating that potential strategy for producing ever smaller injection event quantities.

Figure 3A:
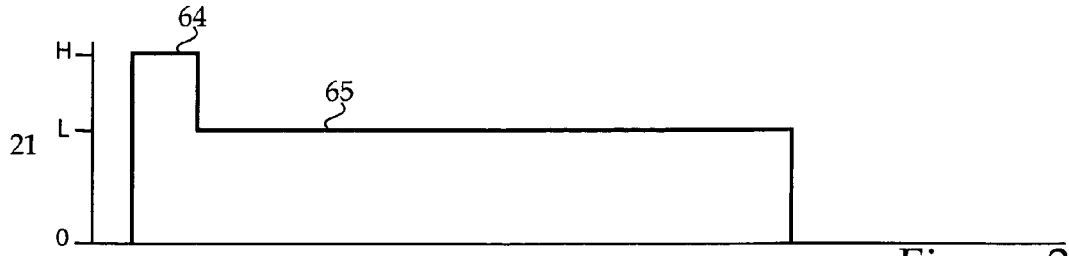
FIGS. 3*a-f* represent graphs of a first electrical actuator control signal, spill valve position, a second electrical actuator control signal, needle control chamber pressure, injection pressure, and injection rate, respectively, versus time for an example main plus post injection sequence according to the present disclosure, and with a comparison to a predecessor fuel injector.
Figure 3B:
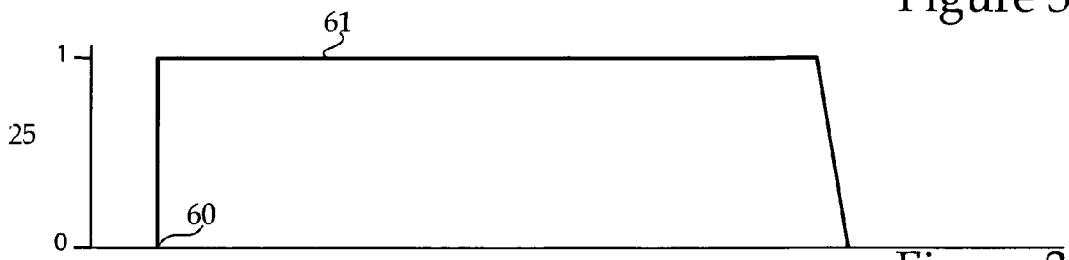
Figure 3C:
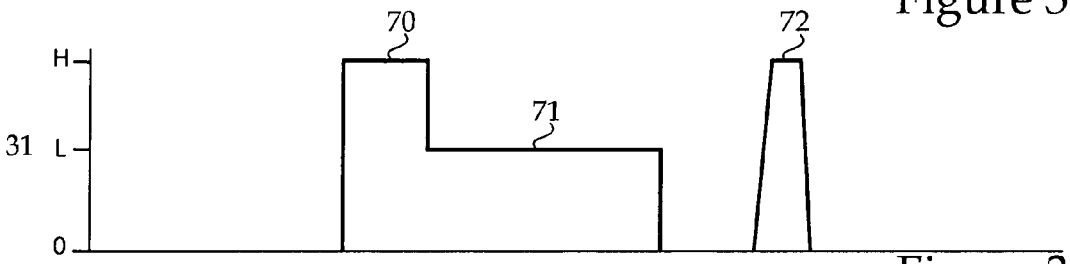
Figure 3D:
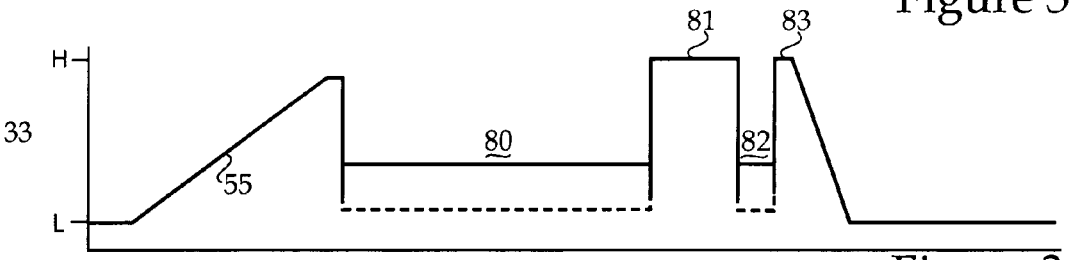
Figure 3E:
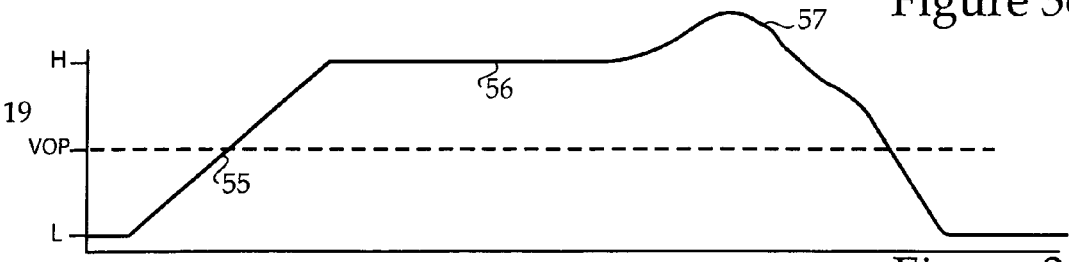
Figure 3F:
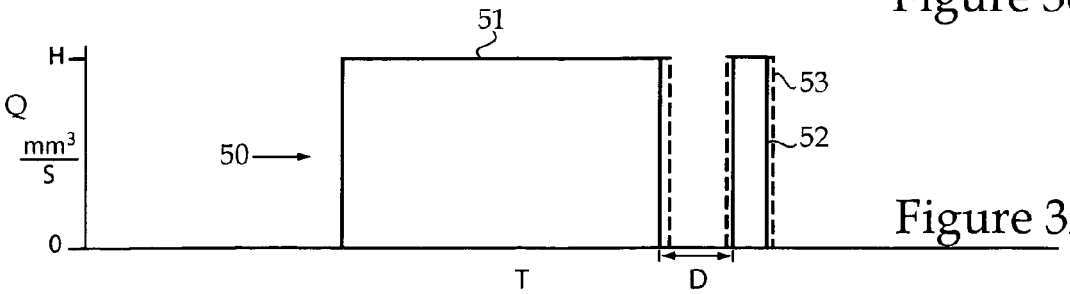

Referring now to FIGS. 3*a-f*, an injection sequence 50 that includes a large main injection 51 and a closely coupled small post injection 52 is shown in FIG. 3*f*. Also shown is a similar result with a large post injection 53 according to the predecessor fuel injector that does not include a Z orifice passage 37. Any injection sequence generally begins when the lobe of cam 9 starts to move plunger 15. As plunger 15 begins moving, first electrical actuator 21 is energized to a pull-in current 64 (FIG. 3*a*) to close spill valve 22. As cam 9 continues to rotate, pressure in nozzle chamber 19 begins to ramp up as per pressure increase 55 shown in FIG. 3*e*. The closure of spill valve 22 is reflected in FIG. 3*b* by the movement of spill valve member 25 from a fully open position 60 to a closed position 61. At this time, second electrical actuator 31 remains de-energized to facilitate a fluid connection via pressure connection passage 35 to needle control chamber 33 and via Z orifice passage 37 so that the pressure therein tracks closely with the pressure increase 55 as shown in FIG. 3*d*. After spill valve member 25 comes to rest at the closed position, the current or control signal to electrical actuator 21 may be dropped to a hold-in level 65 (FIG. 3*a*) that is sufficient to hold spill valve member 25 in the fully closed position 61 as shown in FIG. 3*b*.

When it comes time to initiate the main injection event 51, second electrical actuator 31 is energized to a pull-in current level 70 (FIG. 3*c*) that moves needle control valve 30 to a position that closes pressure communication passage 35, but opens needle control chamber 33 to a low pressure drain passage 49. This causes pressure to quickly drop as shown in low-pressure region 80 (FIG. 3*d*) of needle control chamber 33. However, it is worth noting that the pressure in region 80 is higher with the inclusion of Z orifice passage 37 than the pressure as shown in the dotted line in the predecessor fuel injector. Because pressure in nozzle chamber 19 is above the valve opening pressure (VOP) as shown in FIG. 3*e*, nozzle check valve 32 will lift, and fuel will commence to spray out of nozzle outlets 12 for main injection event 51. As with first electrical actuator 21, second electrical actuator 31 may have its control signal dropped to a low or hold-in current level 71 after the control valve member 40 has come to rest at high pressure seat 41. The main injection event 51 may be terminated by de-energizing second electrical actuator 31 to increase pressure in needle control chamber 33 as shown at 81 in FIG. 3*d*. This results in the abrupt closure of nozzle check valve 32 to end injection through nozzle outlets 12.

It should be noted as shown in FIG. 3*f* that the injection event 51 according to the present disclosure ends slightly more abruptly than a counterpart injection event associated with a predecessor fuel injector due to the presence of Z orifice passage 37. As stated earlier, the Z orifice passage 37 allows for a quicker rise in pressure from a higher pressure starting point within the control chamber 33 bringing a fuel injection event to an end slightly faster than that associated with the predecessor fuel injectors utilizing the same control signal.

Between the injection events, pressure begins to increase as per pressure surge 57 (FIG. 3*e*) during the dwell D (FIG. 3*f*) between main injection event 51 and the post injection event 53. Thus, fuel pressure at the time of post-injection event 53 is relatively high due to pressure surge 57 resulting in a larger than desirable post injection quantity 53 in the predecessor fuel injector. The small post injection event 52 is accomplished by re-energizing the second electrical actuator 31 as shown at 72 in FIG. 3*c* to drop pressure in needle control chamber 33 as shown at region 82 of FIG. 3*d*. But it may be worth noting that the pressure in region 82 remains higher in the current fuel injector 10 than in the predecessor fuel injector shown by the dotted lines. This subtle but important phenomenon renders the needle control aspect more responsive than in the predecessor fuel injector. Thereafter, second electrical actuator 31 is de-energized to again increase pressure in needle control chamber 33 to end the injection sequence 50. Those skilled in the art will appreciate that the injection event could also conceivably be ended by the lobe of cam 9 passing its peak, or by opening spill valve 22 to relieve pressure in fuel injector 10 to below the valve closing pressure sufficient to maintain nozzle check valve 32 in its open position. The valve closing pressure and the valve opening pressure (VOP) may be similar in magnitude.

The present disclosure has the advantage of achieving smaller post injections 52 following relatively large main injections 50 with an increased, decreased or same dwell D between injection events and a smaller quantity post injection 52 in order to achieve better emissions with only a small change to existing hardware, namely, the inclusion of Z orifice passage 37. Those skilled in the art will recognize that the addition of Z orifice passage 37 could be utilized to reduce the post injection quantity even if the dwell were matched or reduced relative to that of the predecessor fuel injector via a suitable adjustment to the control signal for the second electrical actuator 31. The Z orifice passage 37 allows for a decrease in the post injection quantity 52 over the predecessor post-injection quantity 53 (FIG. 3*f*), even in the face of pressure surge 57 that occurs between the injection events. Because the presence of the Z orifice passage 37 allows pressure to be maintained at a higher level of needle control chamber 33, the post injection event 52 is more controllable and hence more predictable with less variability than with the high pressure fluctuations associated with the predecessor fuel injector. Thus, the presence of the Z orifice gives more controllable leeway in choosing an appropriate dwell and smaller injection quantity in the highly unstable time region immediately following a main injection event. The result may be better emissions reduction than an otherwise equivalent fuel system application. Those skilled in the art, however, might take note that control signals might need to be adjusted across the engine's operating range to accommodate for the slightly quicker closing action of nozzle check valve 32 and slower opening behavior of the same at all operating conditions due to the inclusion of Z orifice passage 37.

Although the present disclosure has been illustrated in the context of an injection sequence that includes a large main injection followed by a small post injection, it is foreseeable that the same techniques could be utilized to reduce the minimum controllable injection quantity of fuel injector 10 for any injection event alone or as part of a sequence. For example, the added capabilities provided by Z orifice passage 37 could be exploited at other operating conditions, such as to produce small split injections at idle. And in addition, smaller pilot injections may also be available via the inclusion of the Z orifice passage 37. Thus, the ability to incrementally decrease the minimum controllable fuel injection quantity at all operating conditions and pressures could conceivably be exploited in different ways across an engine's operating range apart from the illustrative example that included an injection sequence with a large main injection followed by a closely coupled post injection.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A fuel injector comprising:

an injector body that defines a nozzle outlet;

a cam actuated plunger slidably positioned in the injector body and being coupled to a tappet extending outside the injector body;

a direct control nozzle check valve that includes a closing hydraulic surface exposed to fluid pressure in a needle control chamber, and an opening hydraulic surface exposed to fluid pressure in a nozzle chamber;

the plunger and the injector body defining a pumping chamber fluidly connected to the nozzle chamber via a nozzle supply passage;

the needle control chamber being fluidly connected to the nozzle supply passage via a Z orifice passage;

a needle control valve positioned in the injector body and being movable between a first position at which the needle control chamber is fluidly connected to a low pressure passage, and a second position at which the needle control chamber is fluidly connected to the nozzle supply passage via a connection passage that is in addition to, and different from, the Z orifice passage; and an electrical actuator positioned in the injector body and operably coupled to the needle control valve; and the Z orifice passage is unobstructed.

2. The fuel injector of claim 1 wherein the needle control valve includes a control valve member in contact with a conical valve seat at the first position, and in contact with a flat valve seat at the second position.

3. The fuel injector of claim 2 further including a spill valve positioned in the injector body and being movable between an open position at which a spill passage fluidly connected to the pumping chamber is open, and a closed position at which the spill passage is closed.

4. The fuel injector of claim 3 further including a first biasing spring operably positioned to bias the needle control valve toward the second position and the spill valve toward the open position.

5. The fuel injector of claim 4 further including a second biasing spring operably coupled to bias the direct control nozzle check valve toward a closed position; and the second biasing spring at least partially encircling the needle control chamber.

6. The fuel injector of claim 5 wherein the needle control chamber, the Z orifice passage and the second biasing spring are disposed in a spring cage component of the injector body.

7. The fuel injector of claim 6 wherein the electrical actuator is a first solenoid; and further including a second solenoid positioned in the injector body and operably coupled to the spill valve.

8. The fuel injector of claim 7 wherein the direct control nozzle check valve includes a needle valve member; and the needle valve member includes a needle in contact with a piston, which supports check lift spacer;

the needle control chamber being defined by the spring cage and the piston; and the check lift spacer being in contact with a stop surface of the spring cage when the needle valve member is in an open position, and out of contact with the stop surface when the needle valve member is in a closed position.

9. The fuel injector of claim 8 wherein the needle biasing spring is received in an annular cavity defined by the spring cage.

10. A method of operating a fuel injector, comprising the steps of:

closing a spill valve while moving a plunger of the fuel injector in response to rotation of a cam;

fluidly connecting a nozzle supply passage to a needle control chamber via a Z orifice passage;

opening a nozzle check valve by fluidly connecting the needle control chamber to a low pressure passage via a pressure communication passage; and closing the nozzle check valve by fluidly connecting the needle control chamber to the nozzle supply passage via a connection passage in addition to the Z orifice passage, while disconnecting the needle control chamber from the low pressure passage;

injecting fuel via the nozzle check valve for a first injection event of a plurality of injection events in an injection sequence prior to the opening step;

injecting fuel via the nozzle check valve for a second injection event in the injection sequence responsive to the opening step; and maintaining the Z orifice passage unobstructed.

11. The method of claim 10 wherein the first injection event is a main injection; and the second injection event is a post injection.

12. The method of claim 11 wherein the step of closing the nozzle check valve includes connecting the needle control chamber to the nozzle supply passage via the pressure communication passage.

13. The method of claim 12 further including a step of maintaining the spill valve closed between the first and second injection events; and wherein a main injection quantity of fuel corresponding to the first injection event is greater than a post injection quantity of fuel corresponding to the second injection event.

14. The method of claim 13 wherein the opening step is accomplished by energizing a first electrical actuator; and the step of closing the spill valve includes energizing a second electrical actuator.

15. The method of claim 14 further including a step of mechanically biasing a spill valve member of the spill valve toward an open position with a spring; and restricting fluid flow in the Z orifice passage relative to fluid flow in the pressure communication passage.

16. A method of operating a fuel injector, comprising the steps of:

closing a spill valve while moving a plunger of the fuel injector in response to rotation of a cam;

fluidly connecting a nozzle supply passage to a needle control chamber via a Z orifice passage;

opening a nozzle check valve by fluidly connecting the needle control chamber to a low pressure passage via a pressure communication passage;

closing the nozzle check valve by fluidly connecting the needle control chamber to the nozzle supply passage via a connection passage in addition to the Z orifice passage, while disconnecting the needle control chamber from the low pressure passage; and the step of opening the nozzle check valve includes moving a control valve member out of contact with a flat valve seat and into contact with a conical valve seat; and biasing the control valve member and a spill valve member of the spill valve with a common spring.

* * * * *